United States Patent [19]

Okada et al.

[11] Patent Number: 4,553,376

[45] Date of Patent: Nov. 19, 1985

[54] AUTOMATIC CONTINUOUS VACUUM PACKAGING METHOD AND APPARATUS

[75] Inventors: Shingo Okada, Tokyo; Yuji Sawa; Kuniomi Adachi, both of Fukushima, all of Japan

[73] Assignee: Kureha Kagaku Kogyo K.K., Tokyo, Japan

[21] Appl. No.: 521,779

[22] Filed: Aug. 9, 1983

Related U.S. Application Data

[62] Division of Ser. No. 175,807, Aug. 6, 1980, Pat. No. 4,419,854.

[30] Foreign Application Priority Data

Aug. 6, 1979 [JP] Japan ..... 54-99457

[51] Int. Cl.[4] ..... B65B 31/02; B65B 9/02

[52] U.S. Cl. ..... 53/511; 53/373; 53/434; 53/567

[58] Field of Search ..... 53/434, 459, 479, 512, 53/567, 570, 373, 432

[56] References Cited

U.S. PATENT DOCUMENTS 4,069,643 1/1978 Young et al. ..... 53/373

*Primary Examiner*—W. D. Bray

*Attorney, Agent, or Firm*—Sughrue, Mion, Zinn Macpeak & Seas

[57] ABSTRACT

A vacuum packaging method and apparatus for packaging solid objects such as food products of various shapes automatically. A web of tubular plastic film is supplied from a roll and drawn over an opening core which opens the plastic film into a rectangular shape. The film is then drawn over the object to be packaged and cut to a predetermined length. In one embodiment, the front end of the film is then sealed and the object urged towards the sealed end. In another embodiment, both ends of the film are left open at this point. The object with the film positioned therearound is transferred to a vacuum chamber. Prior to the chamber being evacuated, tension is applied to the film so as to prevent the formation of creases.

7 Claims, 24 Drawing Figures

AUTOMATIC CONTINUOUS VACUUM PACKAGING METHOD AND APPARATUS

This is a division of application Ser. No. 175,807, filed Aug. 6, 1980, now U.S. Pat. No. 4,419,854.

BACKGROUND OF THE INVENTION

The present invention relates to an automatic continuous vacuum packaging method for relatively large solid materials, specifically food products such as rindless cheese, raw meat or the like.

In order to package such objects under vacuum conditions, there has been provided a prior art method wherein an object to be packaged is set on a holder and then wrapped by hand and thereafter deaerated and sealed with a vacuum chamber, vacuum packer or the like. A large amount of manual labor was required for packaging and it was necessary that the workers' hands were in direct contact with the food products. Therefore, there has been a strong demand for automation of this process. The present inventors earlier proposed a vacuum packaging method as disclosed in Laid-Open Japanese Patent Application No. 54/88486. The process disclosed in that application has been recognized as having some disadvantages as to the results produced and the required equipment such as the fact that the food products to be packaged must be moved a relatively long distance and must be transferred from one conveyor to another after the products have been initially wrapped. In view of these defects, an object of the present invention is to eliminate such deficiencies.

SUMMARY OF THE INVENTION

In accordance with the invention, there is provided a vacuum packaging method for solid objects including the steps of supplying a tubular plastic film from a roll thereof, inserting an end of the film over an opening core for opening the tubular plastic film, drawing the end of the tubular plastic film to a predetermined length to encase the object to be packaged, cutting the film into a segment of predetermined length at a position such that the object is positioned substantially in the middle of the cut segment of the film, transferring the object with the film to a vacuum chamber, evacuating the vacuum chamber, and sealing open ends of the film after the vacuum chamber has been evacuated.

Yet further, the invention may be practiced by a vacuum packaging method for solid objects including the steps of transporting an object to be packaged on a conveyor, stopping the conveyor with the object at a position of a fork positioned below an upper surface of the conveyor, lifting the fork to thereby lift the object, forming a flexible tubular film to a rectangular shape at at least end portions thereof with an opening core, drawing end portions of the rectangular tubular film mounted on ends of arms movable forwardly and backwardly on both sides of the fork, encasing the fork in the object with the film, cutting the film into a segment of predetermined length, separating the claws from the film while simultaneously lowering the fork to a position below the upper surface of the conveyor to thereby set the encased object onto the conveyor, substantially withdrawing the fork from the casing and transporting the object with the conveyor to a vacuum packaging device.

Yet further in accordance with the invention, there is provided a vacuum packaging method for solid objects including the steps of supplying a receiver with an object to be packaged from a side wall aperture in the receiver, lowering a receiving roll means from an intermediate level to a lower level and receiving the object on a bottom plate of the receiver, drawing the film over an opening core, clamping the end of the film opened by the opening core with film drawing means, surrounding the object together with the receiver with the film, cutting the film into a segment of predetermined length, lowering suction means from a position above the receiver and applying suction to both upper end portions of the film, lifting the receiving roll to an intermediate level for supporting the object to the film, retracting the receiver rearwardly and withdrawing the receiver from the film, lifting the receiving roll means and the suction means together to an upper level while lifting the object encased with the film, transferring the object with the film therearound to a vacuum chamber of a first vacuum packaging means together with the suction means, releasing the object in the vacuum chamber, tensioning both peripheries of both ends of the film in the vacuum chamber so as to prevent formation of creases during sealing while releasing vacuum conditions on the suction means and returning the transferring means to the original position thereof, lowering a vacuum chamber covered to seal the vacuum chamber, evacuating the vacuum chamber, moving the first vacuum packaging means laterally while simultaneously moving a second vacuum packaging means to a predetermined position, returning the film tensioning means to the original position thereof, contacting sealing electrodes to each other to the film to seal the film ends while releasing the vacuum conditions in the vacuum chamber, opening the vacuum chamber covered while moving the first vacuum packaging means laterally to return it to its original position.

Still further in accordance with the invention, there is provided a vacuum packaging method for solid objects including the steps of supplying a receiver with an object to be packaged, moving the receiver on which the object has been positioned, drawing the end of the tubular film over an opening core with a film drawing means and surrounding the object together with the receiver, sealing an end of the film with sealing electrodes, cutting the film into a segment of predetermined length, moving suction means into position above the receiver and applying suction to the film at upper end portions of both the open and sealed ends thereof, moving the receiver in cooperation with piston means in a manner so that the object is pushed toward the sealed end of the film, moving the piston means when the receiver has reached a position separated from the open film end so that the object is positioned between the open and sealed film ends and positioned on the receiving roll means through the film, lifting the receiving roll and the suction means to an upper level to thereby transfer the object with the film to a vacuum chamber of a first vacuum packaging means together with the suction means, releasing the object into the vacuum chamber, tensioning both peripheries of the open end of the film to prevent the formation of creases during sealing while simultaneously releasing the vacuum conditions of the suction means and returning the transferring means to an original position thereof, lowering the vacuum chamber covered to seal the vacuum chamber, evacuating the vacuum chamber, moving the first vacuum packaging means laterally while simultaneously moving the second vacuum packaging means to a predetermined position, returning the film tensioning means to an original position thereof, contacting sealing electrodes so as to seal the open end of the film while simultaneously releasing the vacuum condition in the vacuum chamber, and opening the vacuum chamber covered while simultaneously moving the first vacuum packaging means laterally to an original position thereof.

A vacuum packaging apparatus constructed in accordance with the teachings of the invention includes means for transporting objects to be packaged, film supplying means for supplying a tubular plastic film from a roll thereof, an opening core for opening the tubular plastic film into a rectangular shape, means for drawing the tubular film to a predetermined length, means for cutting the film to the predetermined length, a vacuum chamber, means for transferring the object and the film to the vacuum chamber with the object supported on the tubular film, film tensioning means for tensioning the tubular film laterally before sealing, and sealing means.

Another apparatus of the invention includes means for supplying a tubular plastic film, an opening core for opening the tubular plastic film into a rectangular shape, means for drawing the open or forward end of the tubular plastic film through a predetermined length over the opening core and the object to be packaged so as to encase the object with the film, means for cutting the film at a position such that the object is positioned substantially in the middle of the film, a vacuum chamber, means for transferring the object with the film to the vacuum chamber, and means for sealing opened ends of the film after the vacuum chamber has been evacuated.

More specifically, a vacuum packaging apparatus of the invention can be constructed with conveyor means for transporting an object to be packaged to a position adjacent a fork with the fork being initially positioned below an upper surface of the conveyor means and being liftable above the upper surface of the conveyor means, means for supplying a flexible tubular film, an opening core disposed for opening the tubular film to a rectangular shape, means for drawing the film having claws mounted on ends of arms movable forwardly and backwardly on both sides of the fork for moving the film over the opening core and around an object to be packaged, means for cutting the film to a segment of predetermined length, at least one vacuum packaging device including a vacuum chamber, and means for transporting the object to the vacuum packaging device from the position of the fork.

In further specific embodiments, there is provided suction means which is lowerable from a position above a receiver for incoming objects to be packaged for applying suction to upper portions of the film in which the object is encased. There are also provided first and second vacuum packaging means each having a vacuum chamber with the vacuum packaging means being horizontally movable and thus interchangeable. Means may also be provided for tensioning peripheries of ends of the film so as to prevent the formation of creases in the vacuum chamber. Yet further, one end of the film can be sealed before the object is disposed therein. In this case, the object is to be urged against the closed end such as with piston means prior to the remainder of the packaging operation.

BRIEF DESCRIPTION OF THE DRAWINGS

In the accompanying drawings:

FIGS. 2A to 2D are schematic side views of the apparatus shown in FIG. 1 in which FIG. 2A illustrates a state in which an object to be packaged is located at a starting position on a conveyor, FIG. 2B shows a state in which the object to be packaged has been lifted by a fork, FIG. 2C shows a state in which the object has been encased and FIG. 2D shows a state in which one end of the casing has been cut and the object enclosed by the cut casing set on the conveyor and the fork withdrawn from the casing;

DESCRIPTION OF THE PREFERRED EMBODIMENTS

A preferred embodiment of the present invention will be hereinafter described with reference to the accompanying drawings.

Figure 1:
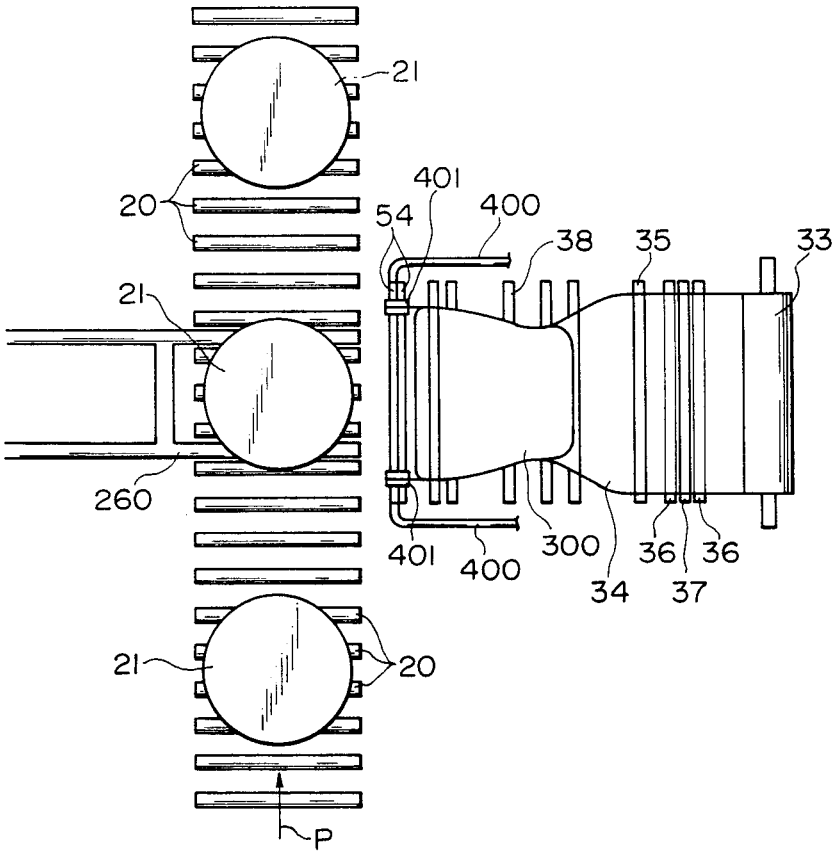
FIG. 1 is a schematic plan view showing an apparatus constructed and operating in accordance with the present invention.
Figure 3:
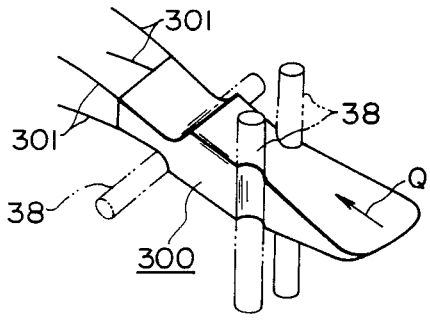
FIG. 3 is a perspective view showing a preferred example of an opening core used with the invention.

FIG. 1 shows a schematic plan view of an apparatus embodying a method according to the present invention. FIGS. 2A to 2D are schematic side views illustrating the processing order corresponding to the packaging order. Referring now to FIGS. 1 and 2A to 2D, reference numeral 33 denotes a continuous roll of folded tubular casing 34 made of a thin synthetic resin material. A dancer roll 37 serves to adjust the supplied amount of film casing 34 in cooperation with stationary guide rollers 36. A pair of pinch rollers serve to supply film casing 34. A plurality of support rollers stationarily support an opening core 300 in such a manner that the position of the core 300 does not fluctuate with respect to the casing 34. The opening core 300 is configured so as to gradually open the flat folded casing 34 and to spread the casing to have a rectangular cross section. The core 300 is supported horizontally by support rollers 38 as shown in FIGS. 1 and 2A to 2D and is thereby prevented from advancing together with the casing 34 by action of friction against the casing 1*a*. Alternatively, the support rollers 38 may be vertically disposed to hold the inner core 300 in position. Referring to FIG. 3 showing a perspective view of a preferred example of an opening core 300, four resilient wires 301 extend from the end of the core 300 as shown for opening the casing 34 moving as in arrow direction Q. A pair of arms 400 (FIGS. 1 and 2A to 2D) are extendible or retractable from either side of the core 300. An associated reciprocating mechanism is provided therefor. This has been omitted from the view of FIG. 1 for purpose of simplification. At the end of the arms are disposed a pair of casing drawer claws or clampers 401 which may be opened and closed for grasping the end of the casing 34 opened in the form of a rectangle in cross section and moving it forwardly. Clampers 401 may be, for example, hinged and suitably opened or closed by means of a cam or an electromagnetic actuator for clamping the ends of the casing 34. Alternatively, the arms 400 may be moved from the opposite direction. A cutter 54 is provided for cutting the film casing 34 drawn by the movable clampers 401 into a unit size for a single object 21 to be packaged. A roller conveyor 20 is arranged perpendicular to the supply direction of the casing 34 for transporting an object 21 in the arm P direction from the lower side in FIG. 1 and transferring it to a vacuum packaging device (not shown in FIG. 1) disposed at the other end thereof. A fork lifter 260 which is disposed facing the opening core 300 is capable of being positioned at the same level as the core 300 or being lowered between rollers of the conveyor 20 or being retracted rearwardly to the left of the conveyor 20 as shown in FIG. 1. Various mechanisms for driving the fork are well-known in the art and hence a detailed description therefor is not necessary.

Figure 2A:
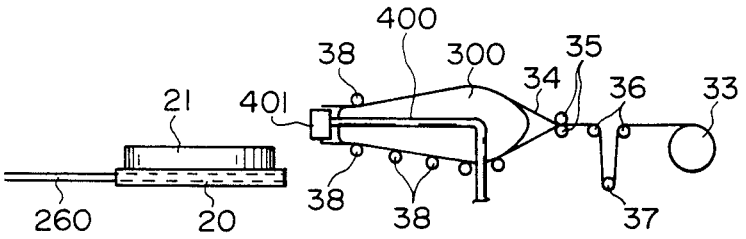
Figure 2B:
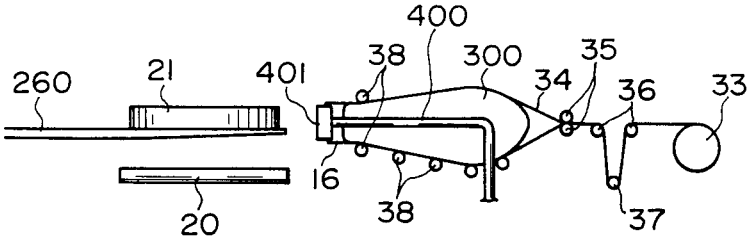
Figure 2C:
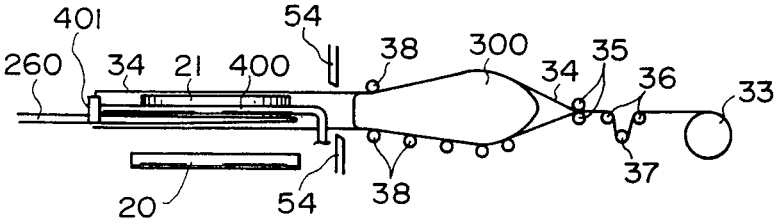

A preferred method according to the present invention utilizing the thus constructed device will now be described. The objects 21 conveyed by the conveyor 20 at the lower end shown in FIG. 1 are transferred by the conveyor to substantially the middle portion of the fork lifter 260 which, as shown in FIG. 2A, and initially positioned between the rollers of conveyor 20 so as not to obstruct the movement of the objects 21. In order to stop an object 21 to be packaged at a desired position, the rotation of the conveyor rollers can be stopped. When an object 21 is stopped at the desired position, the fork lifter 260 is lifted through the spaces between adjacent rollers of the conveyor 20 and the fork 260 stopped, as shown in FIG. 2B, at a level corresponding to the film casing. At the same time, the drawer clampers 401, each clamp peripheral end portions 16 of the rectangular casing 34 and the arm 400 move toward the left in FIG. 2C whereby the solid material 21 is surrounded by or encased with the casing 1*a* as shown in FIG. 2C.

Figure 2D:
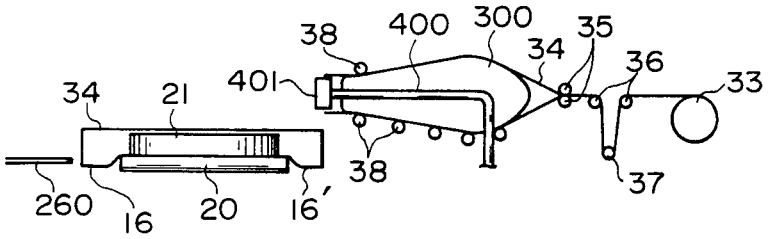

Subsequently, the other end 16' of the film casing 34 is cut by the cutters 54 and the drawer clampers 401 open to release the casing. The arms 400 are then retracted and the clampers 401 again clamp both side ends of the opened portion of the supplied casing 34. The fork 260 is lowered so that the object 21 encased in the casing 34 is located on the cover 20. Then the fork 260 is lowered slightly from the surface of the conveyor 20 and moved rearwardly. The encased object is left on the conveyor 20, the fork 260 is withdrawn from the interior of the casing 34 as shown in FIG. 2D, and the object surrounded by the casing 34 is transferred by the conveyor 20 to the vacuum packaging device (not shown) where it is deaerated and sealed in the normal manner to thereby complete the vacuum packaging.

While a roller conveyor 20 is used in the above-described embodiment, it is possible that a plurality of belt conveyors which are spaced widthwise be used with the fork 260 passing through the spaces between the belt conveyors. Further, modifications are possible within the scope of the present appended claims.

Figure 4:
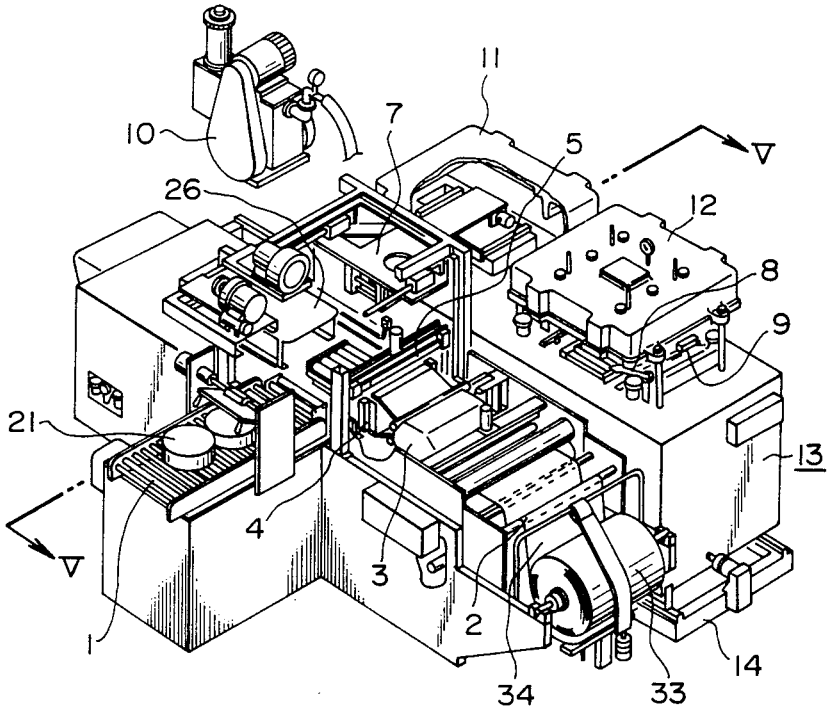
FIG. 4 is a perspective view of an apparatus constructed and operating in accordance with a second embodiment of the present invention.

A second embodiment of the present invention will be hereinafter described with reference to FIGS. 4 to 14. FIG. 4 shows a perspective view of an apparatus operating in accordance with a second preferred method according to the present invention. The apparatus includes supply section 1 for supplying objects to be packaged having a constant configuration such as rindless cheese, tubular film intermittent supply section 2 from a tubular film supply roll 33, an opening inner core 3 for opening the tubular film casing 34, a film drawing device 4 having paired fingers 4' for clamping and drawing the end portions of the tubular film casing 34, a receiver 26 for encasing the objects 21 in the tubular film casing 34, a film cutting device 5 having cutters 54 for cutting the film casing into unit lengths, a transferring section 7 for transferring the objects surrounded by the film casing 34 to a vacuum packaging devices 11 and 12 with the film casing 34 clamped in the advance direction thereof by chucks 58 and 61, a film tensioning device 8 for tensioning the film ends laterally, a sealing device 9, and a vacuum packaging device 9 including a vacuum pump 10. The at least one vacuum packaging device 9 is movable on rails 14.

In the thus constructed apparatus of the present invention, the end 16 of the tubular film is inserted over the inner core 3 to thereby open the film end 16 in the form of a rectangle and both the peripheral portions of the rectangularly opened end 16 of the film 34 are clamped by fingers 4' of the film drawing device 4 to thereby draw the film casing a predetermined constant length and to simultaneously encase an object 21 together with the receiver 26. The film casing 34 is cut between the receiver 26 and the inner core 3 by cutters 54 of the film cutting device 5. Subsequently, the receiving rolls 28 are lifted to the middle position thereof to receive the wrapped object 21 through the tubular casing 34 while at the same time a suction device 55 is lowered from above to assist in receiving the object 21 and to hold the end portions 16 and 16' of the film encasing the object 21 therein by suction. In this state, the receiver 26 is moved rearwardly to withdraw it from the tubular film 34. In this condition, both the ends 16 and 16' of the tubular film 34 are opened in the form of a rectangle.

Figure 5:
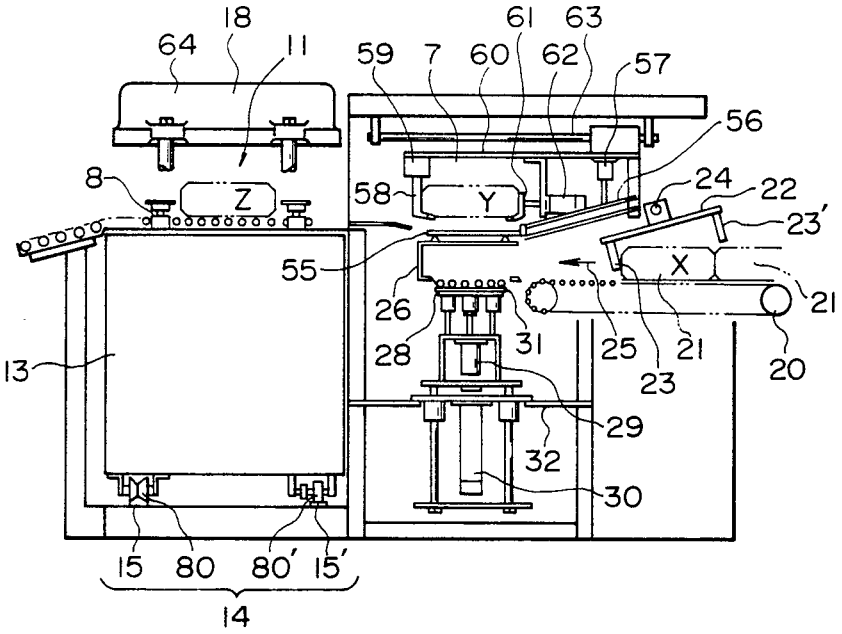
FIG. 5 is a schematic cross-sectional view of the apparatus of FIG. 4 taken along a line V—V.
Figure 12:
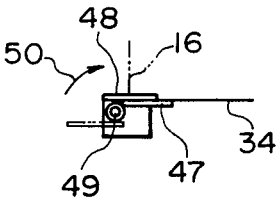
FIG. 12 is an cross-sectional view taken along a line VII—VII in FIG. 11.

Next, the receiving rolls 28 and suction device 55 are lifted together to a position Y shown in FIG. 5. When the wrapped object 21 is lifted to the position Y, the object 21 is clamped in a direction perpendicular to the direction of the film supply by chucks 58 and 61. While clamped, the object 21 is moved together with the suction device 55 from the position Y to a position Z shown in FIG. 5. At this time, the previously completed vacuum packaged object 21 is pushed by an opposite surface of the chuck to the clamped side thereof to thereby remove the object from the vacuum chamber. Inside of the vacuum chamber 18, the chucks 58 and 61 are released to position the object 21 at a position Z shown in FIG. 5. Subsequently, the film casing 34 is expanded outwardly at the ends 16 and 16' by arms 67 of the film tensioning device 8 provided for the vacuum packaging device 11 or 12 as shown in FIG. 12 to prevent the creation of creases as required for subsequent process. When the film tensioning process has been completed, the vacuum pressure of the suction device is released and the suction device is retracted from the vacuum chamber 18 together with the chucks 58 and 61 returning to the original position, that is, the position Y shown in FIG. 5.

Next, a vacuum chamber cover 64 is lowered to seal a vacuum chamber 18 which is evacuated by the vacuum pump 10. At the same time, the vacuum packaging device is moved horizontally while a second vacuum packaging device is moved to a suitable position for the next sequential operaton. Simultaneously, the arms of the film tensioning device 8 are returned to their original positions during the evacuation process. After the vacuum chamber 18 has been evacuated for a predetermined period of time by the vacuum pump 10, electrodes 72 and 73 for sealing are operated to thereby seal the film ends 16 and 16'. Subsequently, the interior of the vacuum chamber 18 which was maintained in the vacuum condition is vented to the atmosphere and the vacuum chamber cover 64 is opened while simultaneously the vacuum packaging device is moved horizontally to return to the position to which the next object 21 has been transferred while the other vacuum packaging device was evacuated. These operations are repeated.

The present invention will now be described in greater detail. FIG. 5 is a cross-sectional view taken along the line V—V direction in FIG. 4. When the object 21 is supplied onto the conveyor 20, the object 21 is stopped at a position in abutment with a rod 23 mounted on a rocking arm 22. In response to an electrical signal generated by an electrical control circuit (not shown), when the rocking arm 22 is obliquely slanted with the right end thereof lowered, the succeeding object 21 is stopped while simultaneously the first or front object 21 is advanced from the position X in the direction of the arrow 25 and introduced into the receiver 26 from a side wall hole in the receiver 26. At this time, the upper surface defined by the receiving rolls 28 is slightly higher than the upper surface of the bottom plates 75 of the receiver 26 at best shown in FIG. 7A and the rolls 28 are each rotated so that the object is positioned at a predetermined position. The object 21 is stopped at a position shown in FIG. 6 in response to the presence of a detecting signal outputted by a photoelectric detector (not shown). Subsequently, the receiving rolls 28 are lowered by an air cylinder 29 shown in FIG. 5 so that the object 21 is received only by the bottom plates 75 of the receiver 26. In this case, a fork which is movable through the spaces between the rolls 28, as described with reference to the previous embodiment, may be used instead of the bottom plates 75 of the receiver 26.

The object 21 in this state is covered with the tubular film 34. The film supply section 2 includes the film roll 33 and a plurality of supply rolls 35, 36 and 37. The tubular film is supplied by a pair of pinch rollers 35 through a plurality of guide rollers 36 and a dancer roller 37 with the pinch rollers 35 being intermittently movable. The tubular film 34 is opened in the form of a rectangle in cross section by the inner core 3 disposed in front of the rollers 2 of the film supply section.

Figure 8:
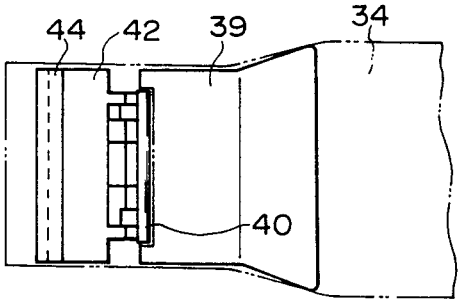
FIG. 8 is an enlarged plan view showing the inner core used in the embodiment of FIGS. 6A to 6C.
Figure 9:
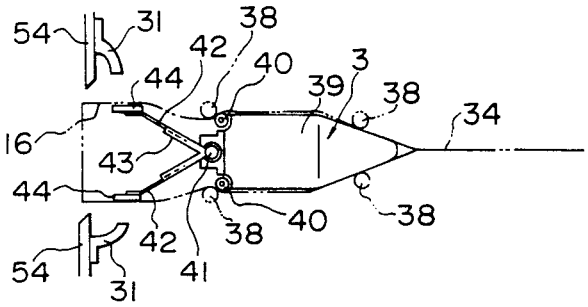
FIG. 9 is an enlarged side view showing an inner core used in the embodiment of FIGS. 6A to 6C.

Referring now to FIGS. 8 and 9, the inner core 3 utilized in this embodiment of the invention will be described in detail. The body 39 of the inner core 3 is provided with a pair of rollers 40 mounted horizontally and is stationarily supported by associated guide rollers 38 disposed on both the front and rear sides as best shown in FIG. 9. A pair of swingable plates 42 are rotatably engaged with a shaft 41 mounted on a front end of the core body 39. The swingable plates 42 are provided with a sliding plate 44 on which the film 34 may be slidingly transferred. The paired plates 42 are biased to a normally open position by a spring 43.

The thus constructed core 3 is encased by the tubular film 34 and supported by the four guide rollers 38 after which the tubular film 34 is cut at a position in the vicinity of the plate 42 ends so that the cut end portion of the film 34 is automatically opened into a rectangular shape. It is desirable to provide the cutters 54 with plate pushers 31 for facilitating the cutting of the tubular film.

Figure 10A:
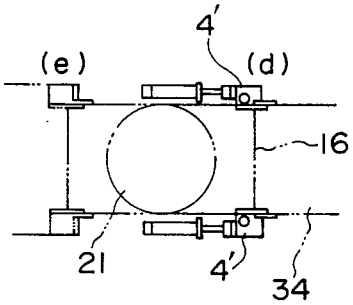
FIGS. 10A and 10B are, respectively, a schematic enlarged plan view and schematic enlarged side view showing a film drawing device and finger plates used in the embodiment of FIGS. 6A to 6C.
Figure 10B:
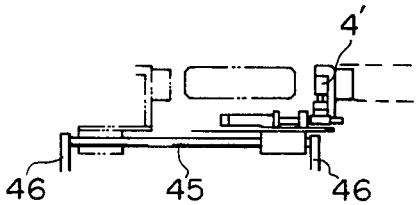

The film drawing section 4 will now be described in greater detail with reference to FIGS. 10A and 10B. The cut and opened end 16 of the tubular film is clamped by fingers 4' at two positions thereof and is drawn from a position d to a position e shown in FIG. 10A along a shaft 45 mounted on a bracket 46 (see FIG. 10B). The film 34 and the receiver 26 are together covered with the tubular film 34. A drive mechanism for the drawing section is not shown but the clamping fingers 4' are operated in synchronization with the above-described pinch rollers 35 in order to effectively supply the tubular film 34.

Figure 6A:
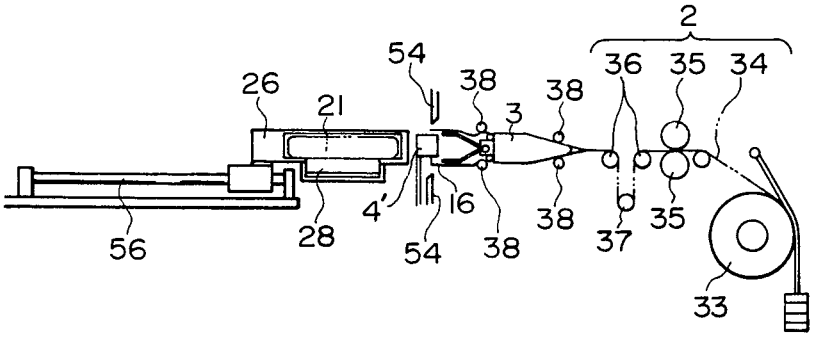
FIGS. 6A to 6C are schematic side views illustrating the operations of the film supply section, the inner core and the receiver of the apparatus shown in FIGS. 4 and 5.
Figure 6B:
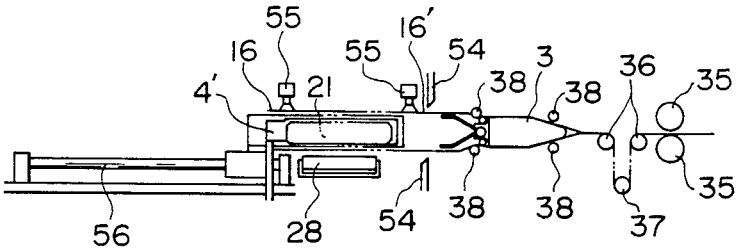
Figure 11:
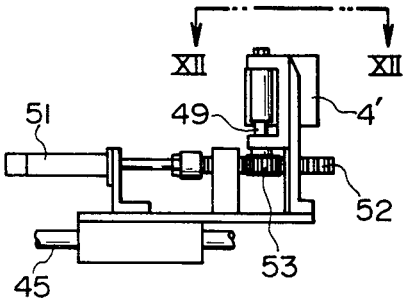
FIG. 11 is an enlarged schematic view showing an example of the finger plates.

FIGS. 11 and 12 show an enlarged view of the fingers 4'. A rack 52 is reciprocatingly moved by an air cylinder 51 to thereby rotate a pinion 53 which in turn rotates a shaft 49. As a result, a movable finger plate 48 fixed to the shaft 49 is also rotated in the direction of the arrow 50 to thereby clamp the end 16 of the film with an associated fixed finger plate 47. The resultant state is shown in FIGS. 6B and 7B.

Figure 6C:
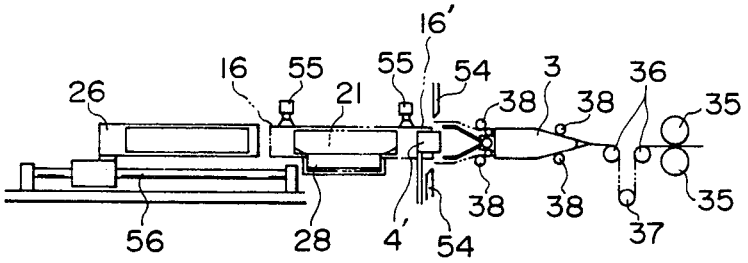
Figure 7A:
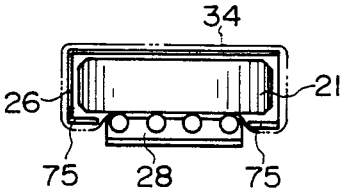
FIGS. 7A and B are schematically enlarged side views illustrating the operational order of the receiving rolls, and the receiver shown in FIGS. 6A to 6C.
Figure 7B:
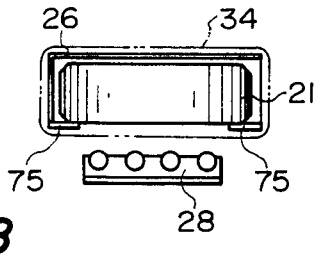

Subsequently, as shown in FIGS. 6C and 7A, the receiving rolls 28 are lifted to the intermediate level to move the object 21 upwardly through the film 34. Simultaneously, the film end 16 is released from the fingers 4' and the film 34 is cut by the cutters 54 at a predetermined length. Then, the suction device 55 is lowered from the upper level to each of the end portions 16 and 16' of the film casing. In this state, the receiver 26 is retracted from the film casing 34 as shown in FIG. 6C.

With reference to FIG. 5, the receiving rolls 28 on which the object 21 is disposed with the film casing are lifted to the position Y by an air cylinder 30 mounted on a frame 32. At the same time, the suction device 55 is lifted by an air cylinder 57 through a lever 56. Then, the object 21 is clamped by a chuck arm 58 moved by a rotary cylinder 59 mounted on a movable plate 60 and by an associated chuck arm 61 moved by an air cylinder 62 and also mounted on the movable plate 60. The movable plate 60 is moved along a shaft 63 and the suction device mounted on the movable plate 60 through lever 56 and the air cylinder 57 are moved together therewith to carry the object 21 to the position 2. At this time, the chuck arm 58 pushes the finished vacuum packaged object away from the vacuum chamber. The chuck arms 58 and 61 are then disengaged from the object 21 in the middle of the vacuum chamber to position it suitably.

Next, as described with reference to FIGS. 13 and 14, the film tensioning device 8 mounted on the base plate 69 is operated. More specifically, the rectangularly opened film ends 16 and 16' are tensioned outwardly in the directions indicated by arrows, respectively, by rotary cylinders through arms 67 and 67' each pivotally mounted on shafts 68 and 68' to thereby prevent the generation of creases during sealing. At the same time, the vacuum state in the suction device 55 is released and the movable plate 60 is returned to its original position. Then, the cover 64 for the vacuum chamber is lowered by an air cylinder 66 along shafts 65 and sealed by packing 17. The vacuum chamber 18 is then evacuated by the vacuum pump 10. The vacuum packaging device 11 is moved horizontally while at the same time the second vacuum packaging device 12 is moved to the predetermined position. The paired vacuum packaging devices 11 and 12 are reciprocated on rails 15 and 15' by the rotation of wheels 80 and 80'.

Figure 13:
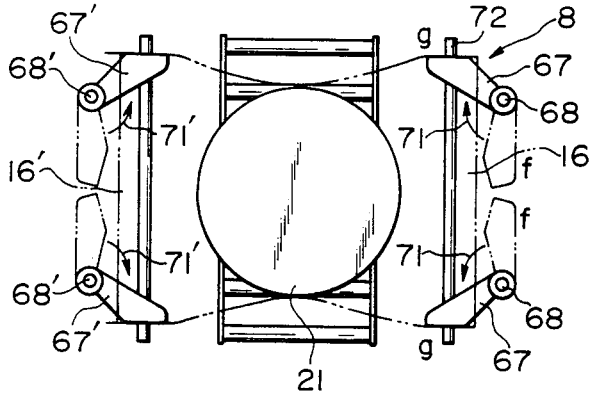
FIG. 13 is an enlarged schematic plan view showing an example of a film tensioning device used in the embodiment of FIGS. 6A to 6C.
Figure 14:
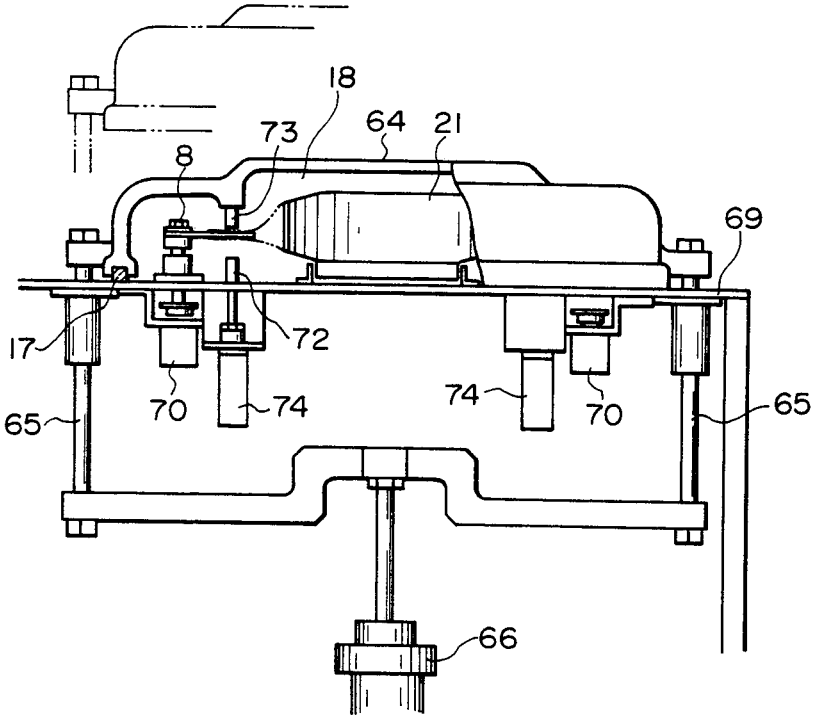
FIG. 14 is an enlarged schematic side view showing a vacuum chamber and vacuum chamber cover used in the embodiment of FIGS. 6A to 6C.

On the other hand, in the vacuum chamber 18, the film tensioning arms 67 and 67' are returned from positions g to f shown in FIG. 13. After applying a vacuum pressure of a predetermined period of time, a lower electrode 72 is brought into abutment with upper electrodes 73 by action of the air cylinders 74 to thereby seal the film ends 16 and 16'. Simultaneously with this action, the vacuum state is released. The cover 64 for the vacuum chamber is lifted and opened by the air cylinder 66 and then the vacuum packaging device 11 is horizontally returned to its original position where the next object 21 is to be transferred while the vacuum chamber of the second vacuum packaging device 12 is evacuated.

Figure 15A:
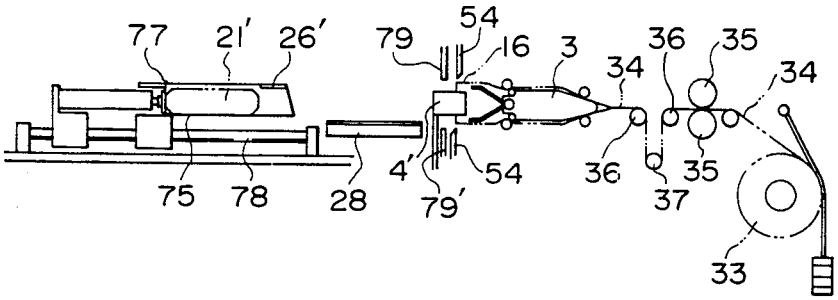
FIGS. 15A to 15C are schematic illustrations of a third embodiment of the present invention.
Figure 15B:
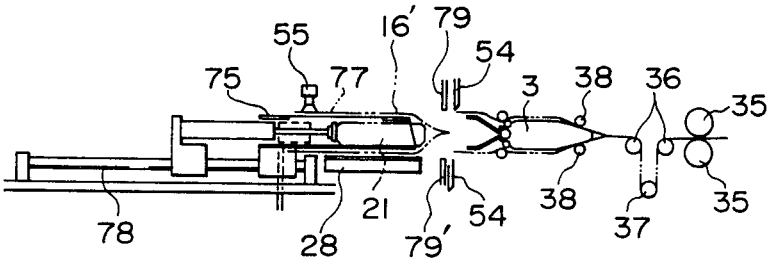
Figure 15C:
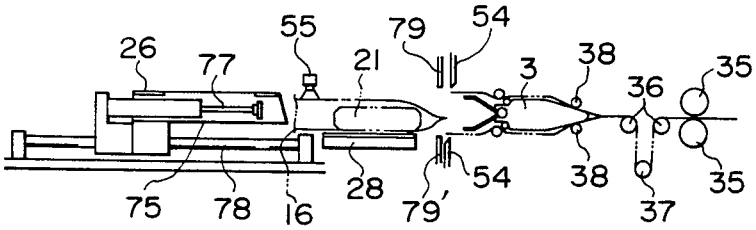

FIGS. 15A to 15C shown another embodiment according to the present invention in which like components are designated with the same reference characters as in the previously described embodiment. The embodiment shown in FIGS. 15A to 15C is especially suitable for packaging irregular, deformable and soft materials such as raw meat. In the preceding embodiments, both ends of the cut film casing are sealed in the vacuum chamber. However, with this embodiment, it is possible to seal one end of the film casing before the object to be packaged is encased therein. Thus, soft and deformable materials are well packed. It is, of course, possible to apply this method to solid hard objects such as rindless cheese. In order to achieve such an end seal packaging, it is highly desirable to seal one end simultaneously with the cutting of the film. Also, it is necessary to push, such as with a piston assembly, the soft solid object in order to place it inside the casing on the moving receiver.

In FIGS. 15A–15C, a soft deformable object 21' is positioned in the receiver 26'. A piston 77 is provided for the receiver 26' cooperating therewith for encasing the soft object 21' in the casing of which one end has been previously sealed. The receiver on which the object 21' is disposed is advanced while both edges of the end 16 of the tubular film opened into a rectangular shape by the inner core 3 are drawn by the fingers 4' of the film drawing section 4 to thereby enclose the object 21' with the film casing. A pair of sealing electrodes 79 and 79' are positioned behind the cutters 54 as shown in FIGS. 15A to 15C. With these electrodes, the other end 16' of the film casing 34 is sealed and thereafter the portion near the end 16' is cut by the cutters 54. Subsequently, the end portion near the ends 16 and 16' is drawn upwardly by the suction device 55. While the object 21' is pushed toward the sealed end, the receiver 26' is withdrawn. When the receiver 26' is passed the film end 16, the piston 77 is also retracted so that the object 21' is then positioned between the ends 16 and 16'. Following this, object 21' is received on the receiving rolls 28.

It is preferable that the positions of the inner core 3, the cutter 54 and the sealing electrodes 79 and 79' be adjustable in order to accommodate different sizes and shapes of objects and to be able to freely change the length of the film casing. It is necessary that the closed film end 16' be always positioned at a constant position as in the preceding embodiments.

Also, while in the embodiment shown in FIGS. 4 to 14 two pairs of arms 67 are used in the film tensioning device and two pairs of sealing electrodes are used in the sealing device, only a single pair is necessary in this embodiment. The other components are constructed and used in the same manner as in the previously described embodiment.

As mentioned above, according to the present invention, the packaging operation is fully automatically conducted as it is only necessary to place an object to be wrapped on the conveyor and to set the tubular film roll at a suitable position. Further, the present invention may be applied to packaging soft and deformable objects such as unrefrigerated meat and also objects which have been divided into several parts.

More specifically, the automatic vacuum packaging apparatus according to the present invention encompasses both a device in which objects to be packed are inserted into a tubular film both ends of which have been opened and the ends are sealed by the electrodes and also a device in which one end of the tubular film end has been sealed and thereafter the object to be wrapped is inserted into the tubular film. It is possible to utilize various modifications of the material receiver. For example, as shown in FIG. 15A, the receiver is opened upwardly in order to receive objects from the upper portion and the bottom plate thereof is formed as a single flat plate. The use of a flat plate is preferable because of the presence of the piston assembly. In case that juicy objects are to be processed, the flat plate may be slantingly mounted to direct the runoff to one side.

What is claimed is:

1. A vacuum packaging apparatus comprising:

receiving means for objects to be packaged;

means for supplying a flexible tubular film;

an opening core for opening said tubular film to a rectangular shape;

means for drawing an end of said tubular film over said opening core and over said object together with said receiving means;

electrode means for sealing said end portion of said film;

means for cutting said film into a segement of predetermined length;

suction means movable into a position above said receiver for applying suction to said film at upper end portions of both open and sealed ends thereof;

piston means cooperating with said receiver for moving said object into a position against said sealed end of said film;

first and second vacuum packaging means each having a vacuum chamber;

means for transferring said object with said film to one of said vacuum chambers;

means for tensioning both peripheries of said open end of said film to a rectangular shape so as to prevent the formation of creases during sealing in said vacuum chamber;

means for sealing said open end of said film in said vacuum chamber;

means for removing said object from said vacuum chamber;

means for horizontally moving said first and second packaging means.

2. The vacuum packaging apparatus as defined in claim 1 further comprising intermittent object supplying means including a moving arm responsive to an electrical signal for supplying objects one-by-one.

3. The vacuum packaging apparatus as defined in claim 1 wherein said opening core includes a core body and a pair of spring biased plates pivotally mounted on one end of said core body.

4. The vacuum packaging apparatus as defined in claim 1 wherein said drawing means includes finger plates for clamping the peripheries of the open film end.

5. The vacuum packaging apparatus as defined in claim 1 wherein said transferring means includes said suction means, chuck arms for clamping said object material through said film in a direction perpendicular to the film supplying direction and lifting said object and, means for transferring said vacuum chamber and for pushing completed object outside the vacuum chamber.

6. The vacuum packaging apparatus as defined in claim 1 wherein said film tensioing means includes at least one pair of arms for expanding at least one end of said film.

7. The vacuum packaging apparatus as defined in claim 1 wherein said sealing electrode means are disposed adjacent said cutting means, said electrode means be movable with said cutting means, and said piston means therefor being provided on said receiving means.

* * * * *